United States Patent [19]

Capo

[11] 4,272,010

[45] Jun. 9, 1981

[54] FOOD SERVICE CONTAINER AND LID

[75] Inventor: James L. Capo, Middletown, Ohio

[73] Assignee: International Paper Company, New York, N.Y.

[21] Appl. No.: 117,319

[22] Filed: Jan. 31, 1980

[51] Int. Cl.[3] ..... B65D 43/06; B65D 05/64

[52] U.S. Cl. ..... 229/43

[58] Field of Search ..... 229/43

[56] References Cited

U.S. PATENT DOCUMENTS

| | | | |
|---|---|---|---|
| 2,944,725 | 7/1960 | Hayes | 229/43 |
| 2,970,735 | 2/1961 | Jacre et al. | 229/7.5 MF |
| 3,084,842 | 4/1963 | Beech | 229/2.5 R |
| 3,531,298 | 9/1970 | Donahue | 229/43 X |
| 3,580,478 | 5/1971 | Bemiss | 229/43 |
| 3,675,811 | 7/1972 | Antz | 229/2.5 R X |
| 3,854,649 | 12/1974 | Wagner | 229/43 X |
| 3,902,540 | 9/1975 | Commisso | 229/2.5 R X |
| 3,927,820 | 12/1975 | Wagner | 229/43 X |
| 3,935,962 | 2/1976 | Schubert et al. | 229/43 X |
| 3,938,726 | 2/1976 | Holden et al. | 229/2.5 R |
| 3,968,921 | 7/1976 | Jewell | 229/2.5 R X |
| 3,984,027 | 10/1976 | Smith | 229/2.5 X |
| 4,173,655 | 11/1979 | Capo | 229/35 |
| 4,190,191 | 2/1980 | Forbes, Jr. | 229/43 |

FOREIGN PATENT DOCUMENTS

| | | | |
|---|---|---|---|
| 2427937 | 2/1975 | Fed. Rep. of Germany | 229/43 |

*Primary Examiner*—Davis T. Moorhead

*Attorney, Agent, or Firm*—Penelope A. Smith

[57] ABSTRACT

A food service container is provided comprising a rimmed receptacle and a lockable paperboard lid. The lid consists of a cover panel with a pair of extension tabs formed at opposed edges of the cover panel, and a locking assembly depending from each extension tab. Each locking assembly comprises an outer wall panel foldably connected to the extension tab and depending downwardly therefrom, means in each outer wall panel defining a semi-detachable retaining tongue, a bottom wall panel foldably connected to the outer wall panel and extending inwardly therefrom, an inner wall panel foldably connected to the inner wall panel and secured in underlying relation to each extension tab, and an engagement slot formed at the junction of inner wall panel and the glue flap. The lid is locked to the receptacle by engaging the rim of the receptacle in the two slots, and detaching the retaining tongues from the outer wall panels to engage the portions of the rim protruding through the slots so that the retaining tongues exert outward and upward biases on the rim.

21 Claims, 4 Drawing Figures

FOOD SERVICE CONTAINER AND LID

BACKGROUND OF THE INVENTION

This invention relates to containers and lids therefor, and particularly to those intended for use in the food service industry, which provided protection and insulation for foods during transport or temporary storage.

In the food service field, disposable containers are frequently filled with food at one location and transported to another location for consumption. The containers are preferably inexpensive, storable in very small spaces, and suitable for fast assembly by relatively unskilled labor. In addition, such containers should shield their food contents from dirt and dust; minimize heat exchange with surroundings; provide liquid and grease barriers, particularly on the bottom and sides of the container; support the food contents; be reheatable in conventional or microwave ovens; advertise the supplier's products; and serve as attractive dishes for the food.

Containers made of paper, paperboard, plastic, foamed plastic, metal foil, and combinations of these materials are in widespread use. Often desirable container characteristics for a particular product can be most closely approximated by making the lid of the container from lightweight paperboard and the food receptacle from a more expensive material, to provide support, ovenability, grease and liquid barriers or whatever other characteristics the food purveyor considers necessary. The paperboard lid provides protection, insulation, and if desired, advertising at a minimum cost. Difficulties have arisen, however, in providing a quick, easy and reliable method by which relatively unskilled labor can secure the paperboard lid to the receptacle.

SUMMARY OF THE INVENTION

Broadly, the container of the present invention consists of a rimmed receptacle and a locking lid. The lid, which is assembled from a unitary paperboard blank, features a pair of locking assemblies depending from the cover panel, and each locking assembly comprises slot means for engaging the rim of the receptacle, an outer wall panel foldably connected to the cover panel, and means defining a retaining tongue in the outer wall panel. The retaining tongue engages the under side of that portion of the receptacle rim which protrudes through the slot means to lock the lid to the receptacle.

In the preferred embodiment, each locking assembly comprises an outer wall panel foldably connected to the extension tab and depending downwardly therefrom, means in each outer wall panel defining a semi-detachable retaining tongue, a bottom wall panel foldably connected to the outer wall panel and extending inwardly therefrom, an inner wall panel foldably connected to the bottom wall and extending upwardly therefrom, a glue flap foldably connected to the inner wall panel and secured in underlying relation to each extension tab, and an engagement slot formed at the junction of inner wall panel and the glue flap. The lid is locked to the receptacle by engaging the rim of the receptacle in the two slots, and detaching the retaining tongues from the outer wall panels to engage the portions of the rim protruding through the slots so that the retaining tongues exert outward and upward biases on the rim. The heights of the inner and outer wall panels may be greater than the height of the receptacle so that the locking assemblies form legs which hold the receptacle in an elevated position.

The container of this invention may be filled and closed rapidly by unskilled labor. The paperboard lid is inexpensive and suitable for use with rimmed receptacles made from a wide variety of materials so that the characteristics of the container may be tailored to its intended contents. The two-piece construction of the container permits compact storage and minimizes handling losses. Finally, the lid has a large printable surface area for displaying information and advertising.

BRIEF DESCRIPTION OF THE DRAWINGS

To aid in understanding the invention, the accompanying drawings are provided in which.

It should be noted that these drawings are for illustrative purposes only and should not be construed to limit the claims.

DETAILED DESCRIPTION OF THE INVENTION

Broadly, the blank and lid of this invention comprise a cover panel and a pair of downwardly depending locking assemblies, each locking assembly containing an engaging slot and comprising an outer wall panel and a retaining tongue. Various other panels may be included in each locking assembly. The receptacle of this invention comprises a floor surrounded by a sidewall, at least a portion of which is rimmed.

The lid is preferably made from paperboard, although any sanitary, foldable material may be used provided that it will maintain the required structural rigidity. Any number of foldable or formable materials may be used for the receptacle, including metal foil, plastic, paperboard and combinations of these materials.

It will be understood that, while the illustrations show a preferred embodiment of my invention other embodiments are also possible within the spirit of my invention. Some of these embodiments will be discussed in detail later in the disclosure but the embodiments discussed do not represent all embodiments nor are they intended to do so.

Figure 1:
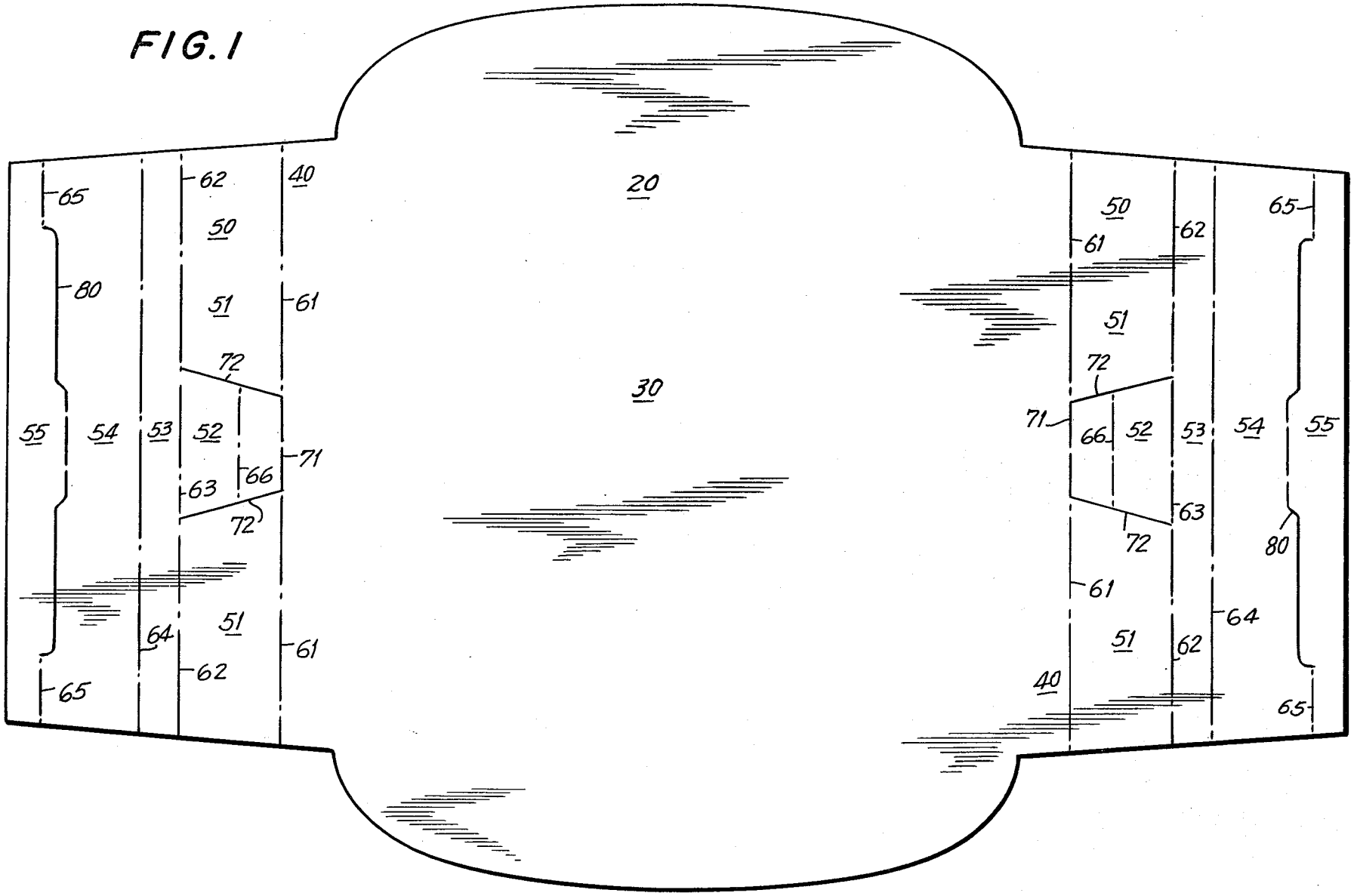
FIG. 1 shows a unitary blank from which the paperboard lid of this invention may be constructed.

Turning now to the drawings, FIG. 1 shows a blank from which a lid embodying my invention may be constructed. The lid, which is generally designated by the numeral, 20, consists of a cover panel, 30, featuring a pair of extension tabs, 40, formed at opposite edges of the cover panel, and a locking assembly foldably connected to each extension tab along first horizontal score line, 61. The locking assembly is generally designated by the numeral 50. It comprises an outer wall panel, 51, a retaining tongue, 52, a bottom wall panel, 53, an inner wall panel, 54, an engagement slot, 80, and a glue flap, 55.

The outer wall panel, 51, is foldably connected to the extension tab, 40, along first horizontal score line, 61, and to the bottom wall panel, 53, along second horizontal score line, 62. The outer wall panel includes means defining a semi-detachable retaining tongue, 52, which means are preferably formed by slit and score lines. It is preferred that the height of the retaining tongue, 52, be substantially equal to the height of the outer wall panel, 51, so that tongue, 52, will exert maximum force when engaging the rim of the receptacle. The shape of the tongue is immaterial, but it has been found that a tongue in the shape of a trapezoid is quite effective. Thus, FIG. 1 shows a trapezoidal tongue, 52, defined by a pair of angled slit lines, 72, a horizontal slit line, 71, which is contiguous with the first horizontal score line, 61, and a third horizontal score line, 63, which is contiguous with the second horizontal score line, 62. In the preferred embodiment, the retaining tongue contains a sixth horizontal score line, 66, whose function will be discussed later in the disclosure.

The bottom wall panel, 53, is foldably connected to the inner wall panel, 54, along fourth horizontal score line, 64. The inner wall panel, 54, is foldably connected to the glue flap, 55, along fifth horizontal score line, 65. The inner wall panel contains slot means, 80, for engaging the rim of the receptacle. In the preferred embodiment, the engaging slot, 80, is located at the junction of the inner wall panel, 54, and the glue flap, 55, the length of the slot being less than the length of the junction. The slot is preferably defined by a curving slit line which is concave in the direction of the glue flap. When the glue flap is folded at right angles to the inner wall panel in assembling the lid, an aperture slot of sufficient width to accomodate the rim of the receptacle is formed. Other means of defining the aperture slot, as, for example, by a stamped cut-out, are also within the scope of my invention.

Figure 2:
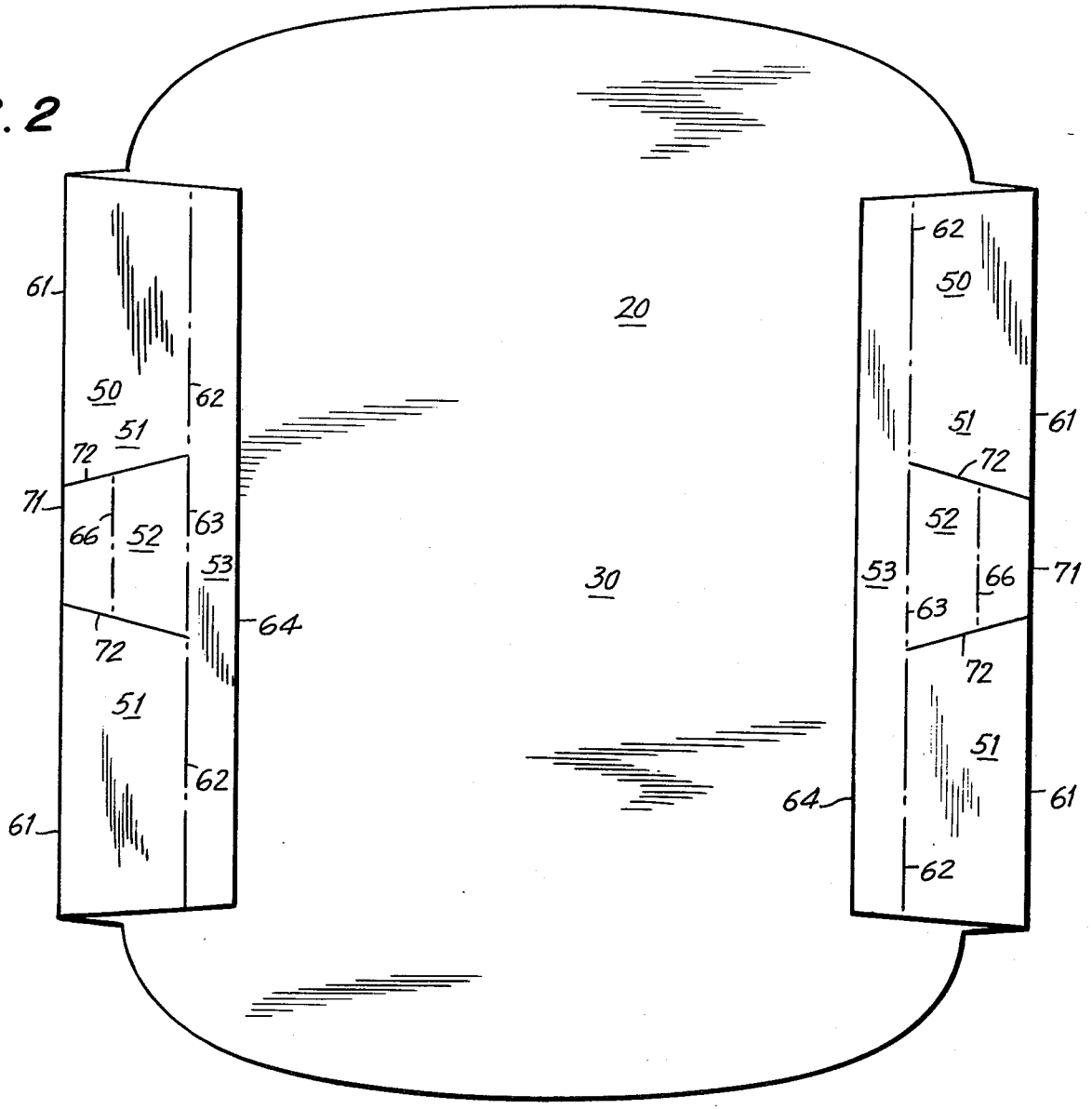
FIG. 2 is a top view of a partially assembled lid formed from the blank shown in FIG. 1.

Referring now to FIG. 2, the blank is preferably partially assembled and glued at the factory as shown before being shipped to the food service outlet. A suitable adhesive is applied to the glue flap, 55. The blank is then folded inwardly along fourth horizontal score line, 64, and again along first horizontal score line, 61, so that the glue flaps and inner wall panels are brought into flat underlying relation to the cover panel and the glue flap is sealed to the underside of the cover panel in the vicinity of the extension tabs. The outer wall panels, retaining tongues, and bottom wall panels are thereby brought into underlying relation to the inner wall panels and glue flaps. In this partially assembled condition, the lid, 20, may be stacked, shipped, and stored with miminal use of space. Moreover, since the retaining tongue, 52, and engagement slots, 80, are contiguous with and protected by the other panels, at this stage of the assembly process, the possibility of damage to the lids during shipping and handling is also minimized.

While the above-described method is preferred if the lid is to be shipped in a partially assembled condition, the adhesive may also be applied to the underside of the glue flap 55 and the flap folded outwardly along fourth score line, 64, so that it is secured to the underside of the cover panel inwardly from the extension tabs. Other securing means, such as heat sealable coatings, stapling, and tab and slot arrangements may also be used.

Figure 3:
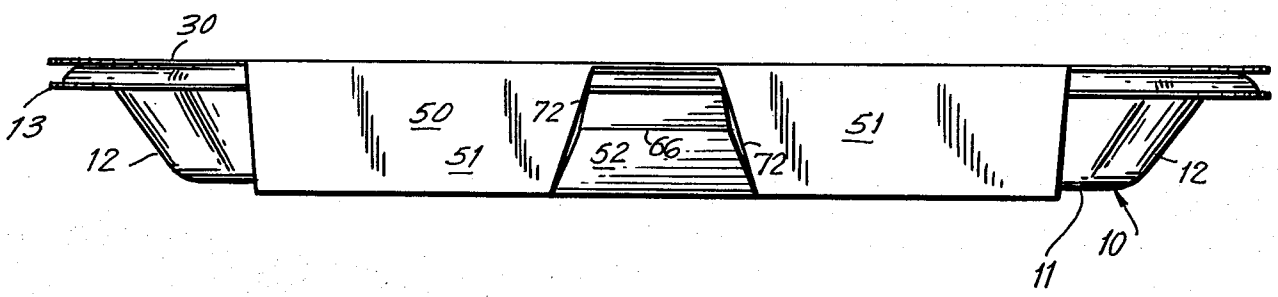
FIG. 3 is a front perspective view of the closed container of the invention, showing the lid of FIG. 2 in fully assembled form.
Figure 4:
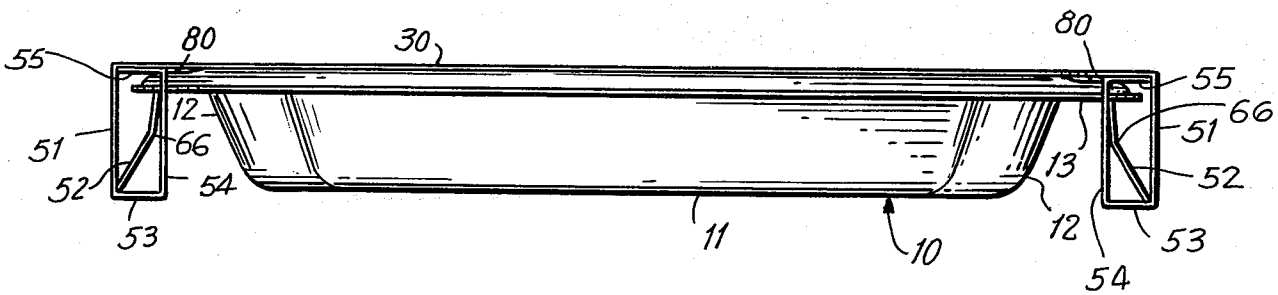
FIG. 4 is a side perspective view of the closed container shown in FIG. 3.

At the food service outlet, the receptacle portion of the container is filled with food. The lid is then fully assembled and secured to the filled receptacle, as shown in FIGS. 3 and 4. The locked container may then be transported, either by the ultimate consumer or by an intermediary such as an airline hostess, to another location where the food is to be consumed.

The receptacle comprises a floor 11, a sidewall 12 connected to and surrounding the floor, and a rim 13 integrally connected to at least a portion of the sidewall of the receptacle. It is preferred that the entire upper circumference of the sidewall be rimmed, since a full rim increases the strength of the container and is less likely to be damaged by careless handling. A full rim is not required, however, for my invention to be operative. My invention merely requires that two opposite portions of the sidewall be rimmed.

After the receptacle has been filled, the container is closed in the following manner. Flattened locking assembly, 50, is flexed open so that each of the wall panels in the locking assembly forms an angle, preferably, of approximately ninety degrees with the adjacent panels. Thus, outer wall panel, 51, depends downwardly from extension tab, 40, at an angle of about ninety degrees; bottom wall panel, 53, extends inwardly from outer wall panel, 51, at an angle, preferably, of about ninety degrees; inner wall panel, 54, extends upwardly from bottom wall panel, 53, preferably, in substantially parallel relation to outer wall panel, 51, and glue flap, 55, extends outwardly from inner wall panel, 54, at an angle, preferably, of about ninety degrees. When the glue flap, 55, is bent along fifth score line, 65, at an angle to the inner wall panel, 54, the area under curved slit line 80 opens up to form a slot deep enough to engage the rim of the receptacle. The lid is then fitted over the receptacle so that portions of the rim engage and protrude through the slot. When the container is hand assembled, the steps of opening the locking assembly and fitting the lid over the receptacle may be performed in a single motion as follows: First, the assembler's thumbs are hooked between the inner wall panels and the cover panel and pulled outward until the locking assemblies are fully opened and the cover panel is slightly flexed. Next, the lid is lowered onto the filled receptacle, the locking assemblies being held away from the sidewall of the receptacle by the pressure of the thumbs. Finally, the thumbs are removed, allowing the natural elasticity of the paperboard to snap the locking assemblies into place with the rim of the receptacle protruding through the engagement slot, 80. Once the rim has been engaged in aperture slot 80, the retaining tongue 52 is pressed inward and slightly downward to engage the underside of the protruding rim. In the preferred embodiment, sixth horizontal score line, 66, is provided in the retaining tongue to facilitate this step and to insure that the pressure exerted on the rim is even across the width of the retaining tongue. The natural elasticity of the paperboard will cause the tongue to exert an outward and upward bias on the portion of the rim protruding through the engagement slot, thereby locking the lid to the receptacle. Once the tongues have been pushed into place, the closure resists sliding or flexing so it is unlikely to be accidentally disengaged.

The consumer may open the container by merely reversing the steps used in closing it, i.e. by disengaging the retaining tongues and then flexing the lid to remove the rim from the aperture slots. However, if desired, another means of opening the container may be provided. For example, a tear-away zipper or tape may be provided running the length of the lid.

The lid may be constructed so as to raise the floor of the receptacle above the surface on which the container is to stand, as shown in FIG. 4. When the lengths of the inner and outer wall panels are substantially equal, and greater than the height of the receptacle side wall, the locking assemblies form sturdy "legs" for the container, and the receptacle, once locked into place, is held in an elevated position. This feature is particularly useful for filled containers which will remain stacked for sometime prior to distribution, as for example, some fast foods and airline dinners. Even if grease or liquid penetrates the floor of one receptacle, the "legs" will prevent leakage onto the lid of the adjacent container. A grease stained container is esthetically unappealing and may make the product unacceptable to the consumer. However, lids which have inner and outer walls which are the same height or shorter than the sidewall of the receptacle are also within the spirit of my invention.

The shape of the receptacle is not a material limitation of my invention. A round, oval, hexagonal, or octagonal shape is preferred since lids for fully rimmed receptacles in these shapes can be made with a minimum of paperboard. For these receptacles, the dimensions of the lid, exclusive of the extension tabs, can be equal to the top dimensions of the receptacle, and the extension tabs will be relatively narrow, about as wide as the width of the rim. However, rectangular and square receptacles can also be fitted with lids by providing locking assemblies which are longer than the rimmed portions of the receptacle.

It is obvious that many modifications may be made in the blank, lid and container described above. For example, almost any locking means may be used for securing the inner wall panel in spaced relation to the outer wall panel. The lower edge of the inner wall panel may be connected to the lower edge of the outer wall panel by a score line, a bottom wall panel, or a series of panels, if the lower edges are connected at all. The exact size and shape of the various panels may be altered so long as the functioning and appearance of the lid are not adversely affected. Furthermore, the shape of the engagement slot is not critical, nor is the shape of the retaining tongue. In view of this, the following claims are intended to cover all modifications and variations as fall within the true scope and spirit of this invention.

What is claimed is:

1. A unitary paperboard lid for a rimmed receptacle comprising:

a cover panel whose outer dimensions are at least equal to the outer dimensions of the top of the receptacle; and a pair of locking assemblies depending from opposite edges of the cover panel, each locking assembly comprising an outer wall panel foldably connected to the cover panel, means in each outer wall panel defining a semi-detachable retaining tongue, an inner wall panel containing slot means for engaging the rim of the receptacle, means for connecting the inner wall panel to the outer wall panel, and means for securing the upper edge of the inner wall panel in spaced relation to the outer wall panel, whereby the slot means is held in spaced relation to the outer wall panel;

the lid being lockable to the receptacle by engaging the rim of the receptacle in the two slot means and detaching the two retaining tongues from the two outer wall panels to engage the portions of the rim protruding through the slot means, whereby each retaining tongue exerts an outward and upward bias on the protruding rim of the receptacle.

2. A lid according to claim 1 wherein the means for securing the upper edge of the inner wall panel comprises a glue flap foldably connected to the upper edge of the inner wall panel and secured in underlying relation to the cover panel.

3. A lid according to claim 2 wherein the slot means is formed at the junction of the inner wall panel and the glue flap.

4. A lid according to claim 3 wherein the means for connecting the inner wall panel to the outer wall panel is a bottom wall panel, the lower edges of the inner and outer wall panels being foldably connected to opposed edges of the bottom wall panel.

5. A unitary paperboard lid for a rimmed receptacle comprising:

a cover panel whose outer dimensions are at least equal to the outer dimensions of the top of the receptacle;

a pair of extension tabs formed at opposite edges of the cover panel;

an outer wall panel foldably connected to each extension tab and downwardly depending therefrom;

means in each outer wall panel defining a semi-detachable retaining tongue;

a bottom wall panel foldably connected to each outer wall panel and extending inwardly therefrom;

an inner wall panel foldably connected to each bottom wall panel and extending upwardly therefrom in a substantially parallel relation to one of the outer wall panels;

a glue flap foldably connected to each inner wall panel, and secured in underlying relation to each extension tab; and, a slot formed at the junction of each inner wall panel with the adjacent glue flap, and having a length less than the length of the junction;

wherein the lid is lockable to the receptacle by engaging the rim of the receptacle in the slots, and detaching the retaining tongues from the outer wall panels to engage the portions of the rim protruding through the slots, whereby the retaining tongues exert outward and upward biases on the rim which lock the lid to the receptacle.

6. A lid according to claim 5 wherein the retaining tongue is defined by slit and score lines.

7. A lid according to claim 6 wherein the height of each retaining tongue is substantially equal to the height of an outer wall panel.

8. A lid according to claims 5 or 7 wherein the retaining tongue is substantially trapezoidal in shape.

9. A lid according to claims 5 or 7 wherein each outer wall panel depends downwardly from an extension tab at an angle of about 90°, and each bottom wall panel extends inwardly from an outer wall panel at an angle of about 90°.

10. A container comprising a receptacle and a separate locking lid, the receptacle comprising a floor a sidewall connected to and surrounding the floor, and a rim integrally connected to at least a portion of the sidewall, and the lid comprising a cover panel whose outer dimensions are at least equal to the outer dimensions of the receptacle, and a pair of locking assemblies depending downwardly from edges of the cover panel, each locking assembly containing slot means for engaging the rim of the receptacle, and comprising an outer wall panel foldably connected to the cover panel, and means defining a semi-detachable retaining tongue in each outer wall panel, the lid being lockable to the receptacle by first engaging the rim of the receptacle in the slot means and then detaching the retaining tongues from the outer wall panels to engage the undersides of those portions of the rim which protrude through the slot means.

11. A container according to claim 10 wherein the entire sidewall of the receptacle is rimmed.

12. A container according to claim 10 wherein each locking assembly further comprises an inner wall panel containing the slot means means for connecting the inner wall panel to the outer wall panel, and means for securing the upper edge of the inner wall panel in spaced relation to the outer wall panel, whereby the slot means are held in spaced relation to the outer wall panels and the retaining tongues exert outward and upward biases on the protruding portions of the rim.

13. A container according to claim 12 wherein the height of the inner wall panels are substantially equal to the height of the outer wall panels and greater than the height of the side wall of the receptacle, whereby the floor of the receptacle is maintained in an elevated position when the lid is locked to the receptacle.

14. A container according to claim 13 wherein the means for connecting the inner wall panel to the outer wall panel is a bottom wall panel, the lower edges of the inner and outer wall panels being foldably connected to opposed edges of the bottom wall panel, and wherein the inner wall panel is secured in substantially parallel relation to the outer wall panel thereby forming a locking assembly having a substantially rectangular cross-section.

15. A container according to claims 12 or 14 wherein the means for securing the upper edge of the inner wall panel comprises a glue flap foldably connected to the upper edge of the inner wall panel and secured in underlying relation to the cover panel.

16. A container according to claims 12 or 14 further comprising means for opening the container.

17. A container comprising a receptacle and a lid, the receptacle comprising a floor, a sidewall connected to and surrounding the floor, and a rim integrally connected to the sidewall; and the lid comprising:

a cover panel whose outer dimensions are at least equal to the outer dimensions of the top of the receptacle;

a pair of extension tabs formed at opposite edges of the cover panel, an outer wall panel foldably connected to each extension tab, and depending downwardly therefrom;

a semi-detachable retaining tongue defined by slit and score lines in each outer wall panel, the lower edge of the tongue being foldably connected to the outer wall panel;

a bottom wall panel foldably connected to the outer wall panel, an extending inwardly therefrom toward the receptacle;

an inner wall panel foldably, connected to each bottom wall panel, and extending upwardly therefrom in a substantially parallel relationship to the outer wall panel;

a glue flap foldably connected to each inner wall panel and secured in underlying relation to one of the extension tabs; and, an engagement slot formed at the junction of each glue flap with the adjacent inner wall panel, the length of the slot being less than the lengths of the glue flap and inner wall panel;

wherein the lid is lockable to the receptacle by engaging portions of the rim in the engagement slots and pressing the retaining tongues inward to engage the portions of the rim protruding through the slots.

18. A unitary paperboard blank for fabricating a locking lid for a rimmed receptacle, the blank comprising:

a cover panel, whose outer dimensions are at least equal to the outer dimensions of the receptacle;

a pair of extension tabs formed at opposite edges of the cover panel;

an outer wall panel foldably connected to each extension tab;

means in each outer wall panel defining a semi-detachable retaining tongue;

a bottom wall panel foldably connected to each outer wall panel;

an inner wall panel foldably connected to each bottom wall panel;

a glue flap foldably connected to each inner wall panel; and an engagement slot formed at the junction of each glue flap with the adjacent inner wall panel, the length of the slot being less than the length of the junction.

19. A blank according to claim 10 wherein the vertical dimension of each retaining tongue is substantially equal to the vertical dimension of an outer wall panel.

20. A blank according to claim 19 wherein the retaining tongue is substantially trapezoidal.

21. A blank according to claims 18 or 20 wherein each retaining tongue contains a horizontal scoreline.

* * * * *